US009272330B2

(12) United States Patent
Arinez et al.

(10) Patent No.: US 9,272,330 B2
(45) Date of Patent: Mar. 1, 2016

(54) METHOD AND APPARATUS FOR MANAGING HEAT ENERGY IN A METAL CASTING PLANT

(75) Inventors: Jorge F. Arinez, Rochester Hills, MI (US); Alaa Elwany, Troy, MI (US); Stephan R. Biller, Birmingham, MI (US); Robert K. Baird, Jr., Clarkston, MI (US); James Benjamin D'Arcy, Attica, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 795 days.

(21) Appl. No.: 13/440,000

(22) Filed: Apr. 5, 2012

(65) Prior Publication Data

US 2013/0268105 A1 Oct. 10, 2013

(51) Int. Cl.

| | |
|---|---|
| ***G06F 19/00*** | (2011.01) |
| ***B22D 46/00*** | (2006.01) |
| ***B22D 47/00*** | (2006.01) |

(52) U.S. Cl.

CPC ..... *B22D 46/00* (2013.01); *B22D 47/00* (2013.01)

(58) Field of Classification Search

CPC ..... G06N 5/04; G06N 99/005

USPC ..... 700/108

See application file for complete search history.

(56) References Cited

U.S. PATENT DOCUMENTS

| | | | | |
|---|---|---|---|---|
| 2003/0074900 | A1* | 4/2003 | McFarland | 60/670 |
| 2007/0055392 | A1* | 3/2007 | D'Amato | G05B 13/048 700/44 |
| 2008/0014537 | A1* | 1/2008 | Atreya | 431/5 |
| 2008/0267249 | A1* | 10/2008 | Della Vedova et al. | 373/79 |
| 2010/0255437 | A1* | 10/2010 | Gibson | F27B 19/00 432/11 |
| 2010/0319348 | A1* | 12/2010 | Jones et al. | 60/670 |
| 2012/0320941 | A1* | 12/2012 | Wakahara et al. | 373/78 |

OTHER PUBLICATIONS

The U.S. Department of Energy's Office of Energy Efficiency and Renewable Energy, A BestPractices Process Heating Technical Brief: Waste Heat Reduction and Recovery for Improving Furnace Efficiency, Productivity and Emissions Performance, 2004.*

* cited by examiner

*Primary Examiner* — Mohammad Ali
*Assistant Examiner* — John Park

(57) ABSTRACT

A method for managing heat energy in a metal casting plant includes executing a local control optimization model to control mass of solid metal charges to each modular melting furnace. The local control optimization model is configured to achieve a commanded total mass of molten material and coincidentally minimize waste heat for each of the modular melting furnaces. The method for managing heat energy in the metal casting plant further includes executing a system control optimization model to manage operation of a heat energy recovery system. The system control optimization model is configured to manage the operation of the heat energy recovery system including transferring the waste heat from the modular melting furnaces to a plurality of heat demand centers while minimizing total loss of the waste heat in the metal casting plant.

16 Claims, 2 Drawing Sheets

METHOD AND APPARATUS FOR MANAGING HEAT ENERGY IN A METAL CASTING PLANT

TECHNICAL FIELD

This disclosure is related to heat energy management within metal casting facilities.

BACKGROUND

The statements in this section merely provide background information related to the present disclosure. Accordingly, such statements are not intended to constitute an admission of prior art.

Metal casting plants use heat to melt metal ingots, chips, and other solid forms, to provide molten metal that is transferred to casting locations. The molten metal is transported to casting locations for molding into a final part. The melting process generates waste heat. Casting plants (i.e., foundries) can be complex industrial facilities that include equipment and processes that demand heating and cooling. This demand for heat energy can be satisfied in part by utilizing the waste heat from the melting process, thus increasing overall energy efficiency of the casting plant.

SUMMARY

A metal casting plant including a plurality of modular melting furnaces is described. A method for managing heat energy in the metal casting plant includes executing a local control optimization model to control mass of solid metal charges to each modular melting furnace. The local control optimization model is configured to achieve a commanded total mass of molten material and coincidentally minimize waste heat for each of the modular melting furnaces. The method for managing heat energy in the metal casting plant further includes executing a system control optimization model to manage operation of a heat energy recovery system. The system control optimization model is configured to manage the operation of the heat energy recovery system including transferring the waste heat from the modular melting furnaces to a plurality of heat demand centers while minimizing total loss of the waste heat in the metal casting plant.

BRIEF DESCRIPTION OF THE DRAWINGS

One or more embodiments will now be described, by way of example, with reference to the accompanying drawings, in which.

DETAILED DESCRIPTION

Figure 1:
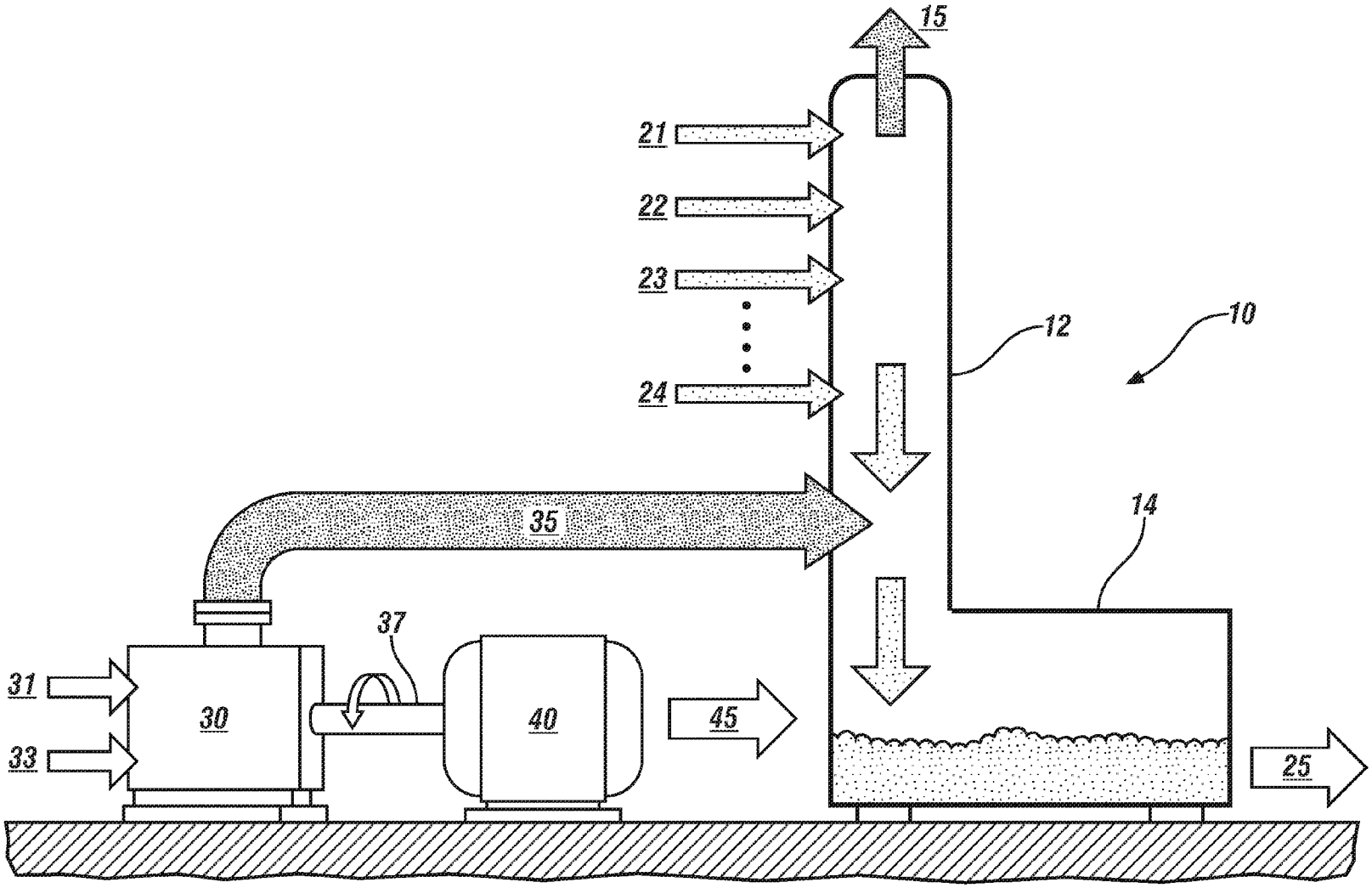
FIG. 1 illustrates an exemplary modular metal melting furnace that is configured to convert metal in solid form to molten form by heating the solid metal, in accordance with the disclosure.

Referring now to the drawings, wherein the showings are for the purpose of illustrating certain exemplary embodiments only and not for the purpose of limiting the same, FIG. 1 schematically illustrates an exemplary modular metal melting furnace 10 configured to convert metal in solid form to molten form by heating the solid metal. In one embodiment, the modular metal melting furnace 10 is a small furnace device that is dedicated to a specific casting line and can be readily relocated. The metal melting furnace 10 includes a melt stack 12 fluidly coupled to a furnace 14. A preferred molten metal charge $Y_t$ 25 is output from the metal melting furnace 10, measurable in units of mass (Kg) or another suitable metric, and may be dictated by a production schedule. Raw material in the form of solid metal is input to the metal melting furnace 10 in one of a plurality of solid forms including, by way of example, metal charges including ingots 21, metal chips 22, gates/sprues 23 removed and recycled from previously cast parts, and other forms 24. Each of the aforementioned metal charges 21, 22, 23, and 24 is measurable in units of mass (Kg) or another suitable metric. A turbine generator preferably includes a gas turbine 30 coupled via a driveshaft to an electric generator 40, and consumes air 31 and natural gas 33 or another combustible gas to generate exhaust heat 35 and torque 37. The exhaust heat 35 is input to the melt stack 12 to preheat the incoming solid metal in the melt stack 12. The torque 37 drives the electric generator 40, which in turn generates electric power 45 that is transferred to the furnace 14 and converted to heat to melt the metal. In one embodiment, the configuration for melting the metal is a cogeneration process. Heat loss in the form of generated waste heat 15 is determined, and includes any heat generated by the gas turbine 30 and the electric generator 40 beyond that which is necessary to melt the metal charges 21, 22, 23, and 24, and may be accounted for as described herein.

The modular metal melting furnace 10 is subject to an optimization process that manages the metal charges 21, 22, 23, and 24 to achieve the preferred molten metal charge 25 that meets a molten metal demand from casting production in the metal melting furnace 10. The optimization process is subject to a limitation of minimizing the generated waste heat 15. The optimization process has the following objective function in EQ. 1:

$$\min_X \sum_i \sum_t W_i X_{it} \quad [1]$$

wherein

- i indicates one of the solid metal charges including metal charges 21, 22, 23, and 24;
- time t indicates a time index, e.g., a period of a production shift, a day, or another suitable time period;
- $X_{it}$ represents a mass of solid metal for the indicated $i_{th}$ one of the metal charges 21, 22, 23, and 24 at time t; and
- $W_i$ indicates waste heat (J) generated per unit of the $i_{th}$ one of the metal charges 21, 22, 23, and 24.

The objective function set forth in EQ. 1 is subject to the constraint that the sum of the solid metal from the metal charges 21, 22, 23, and 24 at time t must be at least equal to the preferred total molten metal charge 25 at time t, represented as follows in EQ. 2:

$$\sum_i X_{it} \geq Y_t \forall t \quad [2]$$

wherein

- $Y_t$ is the preferred molten metal charge 25 that meets the total demand for molten metal at time t to achieve melting production in the metal melting furnace 10; and $X_{it}$ represents the mass of solid metal for the indicated $i_{th}$ one of the metal charges 21, 22, 23, and 24 at time t.

The preferred decision variable is $X_{it}$. Thus the solution set indicates the mass of solid metal for each of the metal charges 21, 22, 23, and 24 at time t.

In one embodiment, linear programming is employed to minimize the objective function set forth in EQ. 1 subject to the constraint set forth in EQ. 2 to determine the mass of metal for each of the metal charges 21, 22, 23, and 24 at time t, thus minimizing the generated waste heat 15 while meeting the production schedule using the preferred molten metal charge 25 that meets the total demand for molten metal at time t to achieve casting production for the specific modular metal melting furnace 10.

Figure 2:
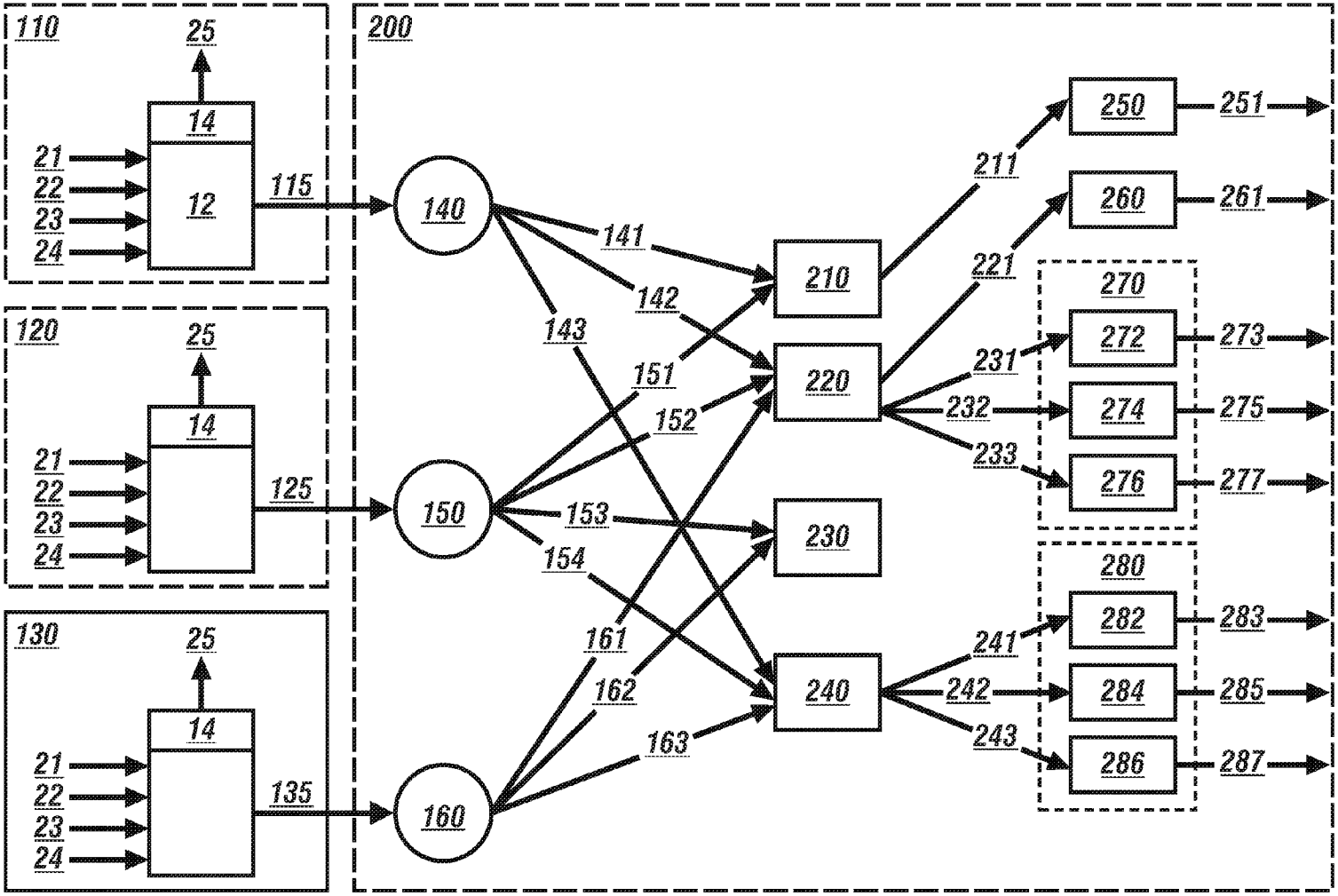
FIG. 2 illustrates a flow diagram representative of a portion of a heat energy recovery system for a metal casting plant including a plurality of modular metal melting furnaces, in accordance with the disclosure.

FIG. 2 schematically illustrates a flow diagram representative of a portion of a heat energy recovery system 200 for a metal casting plant including a plurality of modular metal melting furnaces 110, 120, 130, each of which is analogous to the modular metal melting furnace 10 described with reference to FIG. 1. The described system is illustrative and not restrictive. Operation of the modular metal melting furnaces 110, 120, 130 have corresponding amounts of generated waste heat 115, 125, and 135, respectively, each which is analogous to the waste heat 15 shown with reference to FIG. 1. The generated waste heat 115, 125, and 135 are is conveyed to corresponding nodes 140, 150, and 160 of the heat energy recovery system 200. The nodes 140, 150, and 160 represent physical points within a network of conduits wherein heat energy in the form of hot exhaust gases from the modular metal melting furnaces 110, 120, 130 are distributed.

The generated waste heats 115, 125, and 135 from the modular metal melting furnaces 110, 120, 130 are distributed to a plurality of usage distribution centers, including space heating indicated by node 210, space cooling indicated by node 220, process heating indicated by node 230, and process cooling indicated by node 240. The usage distribution centers have integrated energy conversion processes or devices to convert waste heat energy in the form of hot gases into another form of energy as dictated by process demand requirements. Heat exchangers and absorption chillers are examples of such devices. Other usage distribution centers may be employed depending upon the configuration of the heat energy recovery system 200. The distribution of the generated waste heat 115, 125, and 135 to the plurality of usage distribution centers indicated by nodes 210, 220, 230, and 240 has accompanying heat losses that are indicated by arcs 141, 142, 143, 151, 152, 153, 154, 161, 162, and 163. The usage distribution center employing the aforementioned arcs is illustrative. Other configurations of arcs may be employed.

Heat transfers from the nodes 210, 220, 230, and 240 to a plurality of heat demand centers indicated by nodes 250, 260, 270, and 280. The heat demand centers have integrated energy conversion processes or devices to convert waste heat energy in the form of hot gases into another form of energy as dictated by process demand requirements. Heat exchangers and absorption chillers are examples of such devices. Each distribution from the usage distribution centers indicated by nodes 210, 220, 230, and 240 to the heat demand centers indicated by nodes 250, 260, 270, and 280 has accompanying heat losses that are indicated by arcs 211, 221, 231, 232, 233, 241, 242, and 243. Each of the heat demand centers indicated by nodes 250, 260, 270, and 280 represents a piece of equipment or a process that has one or more demands for heat, including heat demand 251 associated with node 250, heat demand 261 associated with node 260, heat demands 273, 275, and 277 associated with demand centers 272, 274, and 276, respectively, of node 270, and heat demands 283, 285, and 287 associated with demand centers 282, 284, and 286, respectively, of node 280. In one embodiment, the heat demand center indicated by node 250 is associated with space heating, the heat demand center indicated by node 260 is associated with space cooling, the heat demand center indicated by node 270 is associated with process heating, and the heat demand center indicated by node 280 is associated with process cooling. Alternative configurations of usage distribution centers and heat demand centers may be employed with similar effect.

The heat energy recovery system 200 is subject to an optimization process that is employed to manage transfer of the generated waste heat therethrough.

The optimization process may be configured with an objective function as follows in EQ. 3.

$$\min_{X,Y} \sum_i \sum_j \sum_t L_{ij} X_{ijt} + \sum_j \sum_k \sum_t R_{jk} Y_{jkt} \quad [3]$$

wherein

Lij indicates heat loss per unit of heat energy transferred from one of the modular metal melting furnaces 110, 120, 130 to one of the usage distribution centers indicated by nodes 210, 220, 230, and 240 at time t;

$X_{ijt}$ indicates a quantity of heat (J) from one of the modular metal melting furnaces 110, 120, 130 delivered to one of the intermediate nodes j, i.e., one of the usage distribution centers indicated by nodes 210, 220, 230, and 240 at time t;

$R_{jk}$ indicates heat loss per unit of heat energy transferred from one of the usage distribution centers indicated by nodes 210, 220, 230, and 240 to one of the heat demand centers indicated by nodes 250, 260, 270, and 280 indicated by the aforementioned arcs; and $Y_{jkt}$ indicates a quantity of heat delivered from one of the intermediate nodes j, i.e., one of the usage distribution centers indicated by nodes 210, 220, 230, and 240 to one of the heat demand centers k at time t.

The preferred decision variables include $X_{ijt}$, i.e., the quantities of heat from the modular melting furnaces 115, 125, and 135 delivered to the intermediate nodes, and $Y_{jkt}$, i.e., the quantities of heat delivered from the intermediate nodes j, i.e., one of the usage distribution centers indicated by nodes 210, 220, 230, and 240 to the heat demand centers k at time t.

The objective function set forth in EQ. 3 is subjected to a waste heat generation constraint, as follows in EQ. 4:

$$\sum_j X_{ijt} \leq H_{it} \forall\, i, t \quad [4]$$

wherein $H_{it}$ indicates a total supply of generated waste heat at time t from all the modular metal melting furnaces 110, 120, 130.

Thus at each time point including a planning horizon, the solution to EQ. 3 is subject to the limitation that a total quantity of generated waste heat 115, 125, and 135 at time t delivered from the modular metal melting furnaces 110, 120, 130 does not exceed its supply at time t dictated by the production schedule.

Operation of the system includes a constraint to ensure that the heat demands 251, 261, 273, 275, 277, 283, 285, and 287 are satisfied from the heat demand centers indicated by nodes 250, 260, 270, and 280 at each time t, indicated as follows in EQ. 5.

$$\sum_j Y_{jkt} = D_{kt} \forall k, t \quad [5]$$

wherein k indicates the heat demands 251, 261, 273, 275, 277, 283, 285, and 287;

$D_{kt}$ indicates heat demand associated with the selected one of the heat demands 251, 261, 273, 275, 277, 283, 285, and 287 of the demand nodes 250, 260, 270, and 280 at time t; and $Y_{jkt}$ indicates a quantity of heat delivered from intermediate node j, i.e., one of the usage distribution centers indicated by nodes 210, 220, 230, and 240 to demand node k at time t.

Thus for each time t in the planning horizon, the solution to EQ. 3 is subject to the limitation that the demand of each demand node is fulfilled for all time points in the planning horizon.

Operation of the system includes an individual node heat balance constraint, which ensures that the total heat delivered into an intermediate node is equal to the total heat delivered from that node to subsequent demand nodes indicated as follows in EQ. 6.

$$\sum_i X_{ijt} - \sum_k Y_{jkt} = 0 \forall j, t \quad [6]$$

Thus, at each time t including a planning horizon, the solution to EQ. 3 is subject to a heat balance constraint, which ensures that the total heat delivered into an intermediate node is equal to the total heat delivered from that node to subsequent demand nodes.

In one embodiment, linear programming is employed to minimize the objective function set forth EQ. 3 subject to the constraints set forth in EQs. 4, 5, and 6 to determine the quantities of heat from the modular metal melting furnaces 110, 120, 130 delivered to the intermediate nodes j, i.e., one of the usage distribution centers indicated by nodes 210, 220, 230, and 240 at time t and the quantity of heat delivered from the intermediate nodes j, i.e., the usage distribution centers indicated by nodes 210, 220, 230, and 240 to the demand nodes k at time t.

Execution of the local control optimization model set forth in EQ. 1 and the system control optimization model set forth in EQ. 3 to control operation of the heat energy recovery system 200 minimizes operational heat energy consumption while satisfying production requirements under different operating schedules. The operating schedules may include full production, partial production, and non-production. A control system employing the local control optimization model set forth in EQ. 1 and the system control optimization model set forth in EQ. 3 is able to control the diversion of heat in the form of high temperature exhaust gases from a gas turbine to various process and facility loads, thus providing operational flexibility for multiple recovery options. This facilitates use of small, modular cogeneration applications that are physically proximal to process and facility heat loads. Furthermore, natural gas-driven turbine generators produce less $CO_2$ than other known electric generating units, thus allowing emissions reduction. When the waste heat is fully utilized, this will serve to reduce energy usage.

The disclosure has described certain preferred embodiments and modifications thereto. Further modifications and alterations may occur to others upon reading and understanding the specification. Therefore, it is intended that the disclosure not be limited to the particular embodiment(s) disclosed as the best mode contemplated for carrying out this disclosure, but that the disclosure will include all embodiments falling within the scope of the appended claims.

The invention claimed is:

1. Method for managing heat energy in a metal casting plant including a plurality of modular melting furnaces, comprising:

executing a local control optimization model to control masses from a plurality of solid metal charges to each modular melting furnace, the local control optimization model configured to achieve a commanded total mass of molten material and minimize waste heat for each of the modular melting furnaces in accordance with the following objective function:

$$\min_X \sum_i \sum_t W_i X_{it}$$

wherein i indicates one of the solid metal charges;

t indicates a time index;

$X_{it}$ represents a mass of metal for the indicated $i_{th}$ one of the solid metal charges at time t; and $W_i$ indicates waste heat generated per unit of the $i_{th}$ one of the solid metal charges;

wherein the objective function is subject to a constraint that the sum of the solid metal charges at time t must be at least equal to a preferred total molten metal charge at time t; and executing a system control optimization model to manage operation of a heat energy recovery system, the system control optimization model configured to manage the operation of the heat energy recovery system including transferring the waste heat from the modular melting furnaces to a plurality of heat demand centers while minimizing total loss of the waste heat in the metal casting plant.

2. The method of claim 1, wherein executing said local control optimization model comprises executing the local control optimization model to control masses from a plurality of solid metal charges to each modular melting furnace that achieves a commanded total mass of molten material subject to a constraint that a sum of the masses from the solid metal charges is at least equal to a preferred molten metal mass.

3. The method of claim 2, wherein said plurality of solid metal charges are selected from the group consisting of ingots, metal chips, gates and sprues.

4. The method of claim 1, wherein executing the system control optimization model to manage operation of the heat energy recovery system comprises:

executing the system control optimization model to manage transfer of generated waste heat from the modular melting furnaces to deliver heat to a plurality of intermediate nodes while minimizing loss of the waste heat therebetween; and executing the system control optimization model to manage transfer of generated waste heat from the intermediate nodes to the heat demand centers while minimizing loss of the waste heat therebetween.

5. The method of claim 4, wherein each of said intermediate nodes is subjected to a heat balance constraint.

6. The method of claim 1, wherein the objective function of the local control optimization model is subject to a constraint that the sum of the solid metal charges at time t must be at least equal to a preferred total molten metal charge at time t, in accordance with the following relationship:

$$\sum_i X_{it} \geq Y_t \forall t$$

wherein $Y_t$ is a preferred molten metal charge that meets the total demand for molten metal at time t; and $X_{it}$ represents the mass of metal for the indicated $i_{th}$ one of the solid metal charges at time t.

7. The method of claim 1, wherein executing the system control optimization model to manage operation of a heat energy recovery system comprises executing the system control optimization model to manage the operation of the heat energy recovery system including transferring the waste heat from the modular melting furnaces to the plurality of heat demand centers while minimizing total loss of the waste heat in the metal casting plant in accordance with the following objective function:

$$\min_{X,Y} \sum_i \sum_j \sum_t L_{ij} X_{ijt} + \sum_j \sum_k \sum_t R_{jk} Y_{jkt}$$

wherein

Lij indicates heat loss per unit of heat energy transferred from one of the modular melting furnaces to one of a plurality of usage distribution centers;

$X_{ijt}$ indicates a quantity of heat from one of the modular metal melting furnaces delivered to one of the usage distribution centers at time t;

$R_{jk}$ indicates heat loss per unit of heat energy transferred from one of the usage distribution centers to one of the heat demand centers; and $Y_{jkt}$ indicates a quantity of heat delivered from one of the usage distribution centers to one of the heat demand centers k at time t; and wherein the objective function is subject to a waste heat generation constraint in accordance with the following relationship:

$$\sum_j X_{ijt} \leq H_{it} \forall i, t$$

wherein $H_{it}$ indicates a total supply of generated waste heat at time t from all the modular metal melting furnaces; and wherein the objective function is subject to the limitation that the heat demands are satisfied from the heat demand centers at each time t, in accordance with the following relationship:

$$\sum_j Y_{jkt} = D_{kt} \forall k, t$$

wherein k indicates the heat demand center;

$D_{kt}$ indicates heat demand associated with the selected one of the heat demands of the heat demand center k at time t; and $Y_{jkt}$ indicates a quantity of heat delivered from one of the usage distribution centers to heat demand center k at time t.

8. Method for managing heat energy in a metal casting plant including a plurality of modular melting furnaces, comprising executing a system control optimization model to manage operation of a heat energy recovery system, the system control optimization model configured to manage transfer of generated waste heat from the modular melting furnaces to a plurality of heat demand centers and minimize loss of the waste heat in the metal casting plant, wherein executing the system control optimization model to manage operation of a heat energy recover system includes:

executing the system control optimization model to manage the operation of the heat energy recovery system including transferring the waste heat from the modular melting furnaces to the plurality of heat demand centers while minimizing total loss of the waste heat in the metal casting plant in accordance with the following objective function:

$$\min_{X,Y} \sum_i \sum_j \sum_t L_{ij} X_{ijt} + \sum_j \sum_k \sum_t R_{jk} Y_{jkt}$$

wherein

Lij indicates heat loss per unit of heat energy transferred from one of the modular melting furnaces to one of a plurality of usage distribution centers;

$X_{ijt}$ indicates a quantity of heat from one of the modular metal melting furnaces delivered to one of the usage distribution centers at time t;

$R_{jk}$ indicates heat loss per unit of heat energy transferred from one of the usage distribution centers to one of the heat demand centers; and $Y_{jkt}$ indicates a quantity of heat delivered from one of the usage distribution centers to one of the heat demand centers k at time t;

wherein the objective function is subject to a waste heat generation constraint that the sum of the quantity of heat from the modular metal melting furnaces delivered to one of the usage distribution centers at time t is no greater than a total supply of generated waste heat at time t from all the modular metal melting furnaces.

9. The method of claim 8, wherein executing the system control optimization model to manage operation of the heat energy recovery system comprises:

executing the system control optimization model to manage transfer of generated waste heat from the modular melting furnaces to deliver heat to a plurality of intermediate nodes and minimize loss of the waste heat therebetween; and executing the system control optimization model to manage transfer of generated waste heat from the intermediate nodes to the heat demand centers and minimize loss of the waste heat therebetween.

10. The method of claim 9, wherein each of said intermediate nodes is subjected to a heat balance constraint.

11. The method of claim 8, wherein executing the system control optimization model to manage operation of a heat energy recovery system further includes:

wherein the objective function is subject to a waste heat generation constraint in accordance with the following relationship:

$$\sum_j X_{ijt} \leq H_{it} \forall\, i, t$$

wherein $H_{it}$ indicates a total supply of generated waste heat at time t from all the modular metal melting furnaces; and wherein the objective function is subject to the limitation that the heat demands are satisfied from the heat demand centers at each time t, in accordance with the following relationship:

$$\sum_j Y_{jkt} = D_{kt} \forall\, k, t$$

wherein k indicates the heat demand center, $D_{kt}$ indicates heat demand associated with the selected one of the heat demands of the heat demand center k at time t, and $Y_{jkt}$ indicates a quantity of heat delivered from one of the usage distribution centers to heat demand center k at time t.

12. Method for managing heat energy in a metal casting plant including a plurality of modular melting furnaces, comprising:

executing a local control optimization strategy and a system control optimization strategy to minimize an operational heat energy consumption while achieving a desired production requirement under a desired operating schedule;

executing the local control optimization strategy and the system control optimization strategy including:

controlling a plurality of solid metal charge masses to each modular melting furnace to achieve a commanded total mass of molten material for a time period and minimize waste heat for each of the modular melting furnaces; and managing operation of a heat energy recovery system comprising managing transfers of the waste heat from the modular melting furnaces to a plurality of heat demand centers and minimizing total loss of the waste heat in the metal casting plant comprising:

executing a system control optimization model to manage the operation of the heat energy recovery system including transferring the waste heat from the modular melting furnaces to the plurality of heat demand centers while minimizing total loss of the waste heat in the metal casting plant in accordance with the following objective function:

$$\min_{X,Y} \sum_i \sum_j \sum_t L_{ij} X_{ijt} + \sum_j \sum_k \sum_t R_{jk} Y_{jkt}$$

wherein

Lij indicates heat loss per unit of heat energy transferred from one of the modular melting furnaces to one of a plurality of usage distribution centers;

$X_{ijt}$ indicates a quantity of heat from one of the modular metal melting furnaces delivered to one of the usage distribution centers at time t;

$R_{jk}$ indicates heat loss per unit of heat energy transferred from one of the usage distribution centers to one of the heat demand centers; and $Y_{jkt}$ indicates a quantity of heat delivered from one of the usage distribution centers to one of the heat demand centers k at time t;

wherein the objective function is subject to a waste heat generation constraint that the sum of the quantity of heat from the modular metal melting furnaces delivered to one of the usage distribution centers at time t is no greater than a total supply of generated waste heat at time t from all the modular metal melting furnaces.

13. The method of claim 12, wherein controlling said plurality of solid metal charge masses to each modular melting furnace comprises controlling masses of solid metal charges to each modular melting furnace that achieves a commanded total mass of molten material for the time period subject to a constraint that a sum of the masses of solid metal charges is at least equal to a preferred molten metal mass for the time period.

14. The method of claim 12, wherein managing the operation of the heat energy recovery system comprises:

managing transfer of generated waste heat from the modular melting furnaces to deliver heat to a plurality of intermediate nodes while minimizing loss of the waste heat therebetween; and managing transfer of generated waste heat from the intermediate nodes to the heat demand centers while minimizing loss of the waste heat therebetween.

15. The method of claim 14, wherein managing transfer of generated waste heat from the intermediate nodes to the heat demand centers while minimizing the loss of the waste heat therebetween comprises managing operation of the heat energy recovery system subject to a heat balance constraint at each of the intermediate nodes.

16. The method of claim 12, wherein managing transfers of the waste heat from the modular melting furnaces to a plurality of heat demand centers and minimizing total loss of the waste heat in the metal casting plant further comprises:

wherein the aforementioned objective function is subject to a waste heat generation constraint in accordance with the following relationship:

$$\sum_j X_{ijt} \leq H_{it} \forall\, i, t$$

wherein $H_{it}$ indicates a total supply of generated waste heat at time t from all the modular metal melting furnaces; and wherein the objective function is subject to the limitation that the heat demands are satisfied from the heat demand centers at each time t, in accordance with the following relationship:

$$\sum_j Y_{jkt} = D_{kt} \forall k, t$$

wherein k indicates the heat demand center, $D_{kt}$ indicates heat demand associated with the selected one of the heat demands of the heat demand center k at time t, and $Y_{jkt}$ indicates a quantity of heat delivered from one of the usage distribution centers to heat demand center k at time t.

* * * * *